US006164234A

United States Patent [19]

Manschot et al.

[11] Patent Number: 6,164,234

[45] Date of Patent: Dec. 26, 2000

[54] JACK-UP PLATFORM WITH STORAGE TANK AND METHOD FOR INSTALLING SUCH A JACK-UP PLATFORM

[75] Inventors: Dirk Manschot, Krimpen A/D Ussel; Cornelis Mommaas, Dororecht, both of Netherlands

[73] Assignee: Marine Structure Consultants (MSC) BV, Schiedam, Netherlands

[21] Appl. No.: 09/000,714

[22] Filed: Dec. 30, 1997

[30] Foreign Application Priority Data

Dec. 30, 1996 [NL] Netherlands ..... 1004911

[51] Int. Cl.[7] ..... B63B 35/44

[52] U.S. Cl. ..... 114/265; 405/196

[58] Field of Search ..... 114/265, 321; 405/196, 199, 200, 203, 205, 207, 208, 210

[56] References Cited

U.S. PATENT DOCUMENTS 2,953,904 9/1960 Christenson ..... 405/196

FOREIGN PATENT DOCUMENTS 7508843 2/1976 Netherlands .

1430986 5/1973 United Kingdom .

*Primary Examiner*—Jesus D. Sotelo

*Attorney, Agent, or Firm*—Pillsbury Madison & Sutro LLP

[57] ABSTRACT

An assembly of a jack-up platform and at least one storage tank, wherein the jack-up platform is floatingly displaceable and can be set up by using legs, in such a manner that the jack-up platform is located at a distance above the water surface, wherein the storage tank is adapted to be placed on a water bedding and includes attaching the legs, in such a manner that the jack-up platform is supported by the storage tank, wherein the storage tank is adapted to receive at least a hydrocarbon compound such as oil, wherein the hydrocarbon compound can be led into and out of the storage tank, wherein during the support of the jack-up platform, the storage tank extends at least partially below the jack-up platform.

22 Claims, 4 Drawing Sheets

JACK-UP PLATFORM WITH STORAGE TANK AND METHOD FOR INSTALLING SUCH A JACK-UP PLATFORM

The invention relates to a movable jack-up platform according to preamble of claim 1. Such a jack-up platform is known from U.S. Pat. No. 2,589,146.

The known jack-up platform comprises four legs composed of two tubes, which together carry a platform. This platform is connected with each leg at least via guide means. Attached to the lower end of each leg is an airtight water tank comprising means for passing water from and to the surroundings to and from the water tank respectively. During use, each water tank can be moved between a floating position against the lower side of the platform, in which the water tank is completely filled with air, and a supporting position, in which the water tanks are completely filled with water and serve as ground anchor for the leg concerned, in order to increase the stability of the jack-up platform. For moving the water tanks between the two positions use is made of the floating power of the water tanks when filled with air or their heavy weight when the water tanks are filled with water. After the legs have been fixedly supported on the bottom, the platform is moved up along the legs by means of the jack-up means, up to a distance above the water surface.

With this known jack-up platform a storage tank is usually arranged for storing for instance oil or such hydrocarbon compounds. This means that independently of the jack-up platform such a storage tank is to be brought to the place of destination and to be fixed there near the jack-up platform. This means additional costs and relatively much required space. Furthermore, such a storage tank is relatively susceptible to damage, both in use and during transport. A further drawback of this known jack-up platform is that the legs are relatively long and that, in particular during the standing position of the platform, these legs are exposed to relatively high forces, in particular great moments. Moreover, the legs may tend to slightly move relative to each other, for instance owing to displacements as a result of currents and the like. A further drawback of this known installation is that the legs when lowered are not controlled other than by adjusting the contents of the ballast tanks. Consequently, the movements of the legs are not sufficiently controllable.

It is an object of the invention to provide an assembly of the type described in the opening paragraph, in which the above drawbacks are avoided while maintaining the advantages thereof. To achieve this, an assembly according to the invention is characterized by the features of claim 1.

By receiving a storage tank in, at least positioning the storage tank partly under the platform, the platform and the storage tank can be brought together or, if required, apart from each other to a place of destination or be removed therefrom, which is advantageous from a viewpoint of economy, labor technology and environmental technology, while, moreover, the storage tank is properly protected. The storage tank is then multifunctional. During transport and placement this storage tank functions as a ballast means, during use of the jack-up platform it functions as positioning means and as storage tank for hydrocarbon compounds. Since, in use, the jack-up platform is substantially supported by the storage tank, no additional provisions are required to prevent the legs of the jack-up platform from being pressed into the bedding. In fact, the storage tank has a relatively large surface for distributing the forces occurring. Surprisingly, it has been found that, in use, a large part of the weight of the storage tank required for the stability is provided by the weight of the platform and the legs, also in filled condition. Of course, further ballast means can be provided, such as additional weight in or on the storage tank, to increase the stability. Since the legs are interconnected by the storage tank, these legs cannot move apart and can receive the loads occurring better than in the known installation.

Since, in use, the storage tank substantially carries the weight of the jack-up platform, the storage tank is readily prevented from raising as a result of its being filled. In fact, the storage tank is pressed down to the bedding by the weight of the platform and the installations and the like positioned thereon.

An assembly according to the invention can be rapidly and clearly (dis)placed, removed and transported, can be easily constructed and used, has relatively short legs in relation to the depth of use and is very stable. By positioning the or each storage tank relative to the jack-up platform, an assembly according to the invention is moreover space-saving and very functional, at least in use.

Where reference is made in this text to the storage tank, it is to be understood that several storage tanks are possible.

In a first embodiment, an assembly according to the invention is characterized by the features of claim 2.

Since the movements of the (or each) storage tank are controllable by, at least in cooperation with, the jack-up means, a proper control of these movements is possible, on the one hand through the composition of the contents of the storage tank and, on the other hand through the jack-up means. Consequently, for instance too rapid movements of the storage tank can be prevented, so that damage to the storage tank is prevented and, moreover, a very accurate positioning of the storage tank and the platform becomes possible.

The slight difference in weight between the storage tank and the water displaced has the advantage that the jack-up platform is only slightly loaded by the storage tank.

In an advantageous embodiment, an assembly according to the invention is further characterized by the features of claim 3.

During transport of the assembly, sufficient buoyancy must be present, at least in the case of combined displacement, to keep the platform together with the storage tank and the legs floating in a stable condition, in which displacement of the whole should cost as less energy as possible. By filling the or each storage tank in a manner such that in the transport position this storage tank practically floats in the water, the platform is not, at least only minimally, loaded by the storage tank in the vertical direction. On the one hand, it is thus achieved that the platform is not pulled down by the storage tank, more deeply into the water, so that during transport the buoyancy of the platform substantially suffices to keep the jack-up platform floating. On the other hand, it can thus be achieved that the jack-up platform is pushed up, so that the platform can be transported with additional freeboard without becoming unstable. By arranging the supply and discharge means for the fluid and/or the hydrocarbon compound for bringing the or each storage tank into the floating condition, such a favorable equilibrium can be readily obtained. In this context, floating is to be taken to mean that when the storage tank is placed in the water apart in immersed condition, this storage tank would not, at least very slowly, sink or rise, at least under the action of gravity and the upward pressure of the water.

Also when the storage tank is displaced and sunk apart from the jack-up platform, for instance by means of a floating jack-up device, these advantages are obtained, at least as regards the possible control and the slight required force and energy therefor.

In a preferred embodiment, a jack-up platform according to the invention is further characterized by the features of claim 5.

Connecting the legs with the storage tank, with the storage tank interconnecting all the legs, offers a great stability of the installation and moreover a large supporting surface for the jack-up platform. Connecting the legs with the upper side of the storage tank further offers the advantage that because of the height of the storage tank, the length of the legs between the platform and the upper side of the storage tank is smaller than the distance between the platform and the bedding, thus creating a condition more advantageous from a viewpoint of load technology than when the legs extend completely freely down to the bedding. Moreover, the lower ends of the legs are kept together, at least at a fixed distance from each other, by the storage tank. Partly because of these features, the stability of the jack-up platform during use is further increased.

In further elaboration of the invention, an assembly according to the invention is further characterized by the features of claim 7.

The feed-through pipe for feed-through lines and the like has the advantage that these lines are suitably protected during use of the jack-up platform, from near the bedding to near, preferably above, the platform. This has the further advantage that the flow resistance is considerably reduced, as a result of the covering of the separate lines and the like. The above lines may be, for instance, both lines extending from the source for the hydrocarbon compounds to near or above the platform and lines extending from near the platform into the storage tank.

In an alternative embodiment, an assembly according to the invention is characterized by the features of claim 8.

In such an assembly, the storage tank can be displaced and placed separately from the jack-up platform proper, after which the jack-up platform can be transported and placed in the conventional manner, according to the invention on top of the storage tank. This offers the additional advantage that, if required, the jack-up platform can also be removed without displacement of the storage tank, for instance in the case of floating ice, necessary repairs or maintenance and in the event of calamities.

In further elaboration, an assembly according to the invention is characterized by the features of claim 9.

In such an assembly the horizontal forces and moments between the storage tank and the platform can be transmitted via the hardened hardening means. Compared to welding, this has the advantage that the forces to be transmitted can be distributed over a greater area. This way, concentration of tension in the material at the welded area resulting from the forces to be transmitted is prevented, resulting in a connection that provides between resistance against wear from forces generated by currents or wind. Furthermore the possibilities of strain concentrations due to worsened material properties are prevented. A welded connection changes the material properties locally, thus enhancing the wear es material locally. In particular the hardened hardening means comprise a sleeve between the legs and/or feed through pipe and the storage tank. Preferably a welded connection is used as well to absorb axial forces, which connection is advantageously positioned at least partially lower than said hardened hardening means.

The invention further relates to a method for placing a jack-up platform, preferably according to the invention. Such a method is characterized according to the invention by the features of claim 10.

By balancing the weight of the storage tank during transport, in a manner such that in the transport position substantially no or only a slight downward force is exerted by the storage tank, the storage tank can be easily transported and, during combined coupled transport, the usual buoyancy of the platform suffices to keep the assembly floating. Moreover, the stability during transport is not adversely affected. Such a negative effect on the stability could for instance occur when the jack-up platform is slightly pressed out of the water owing to an unduly high buoyancy. Furthermore, the storage tank when being sunk will relatively slowly sink to the bedding by itself, under the action of gravity, without requiring special steps. Thus, too heavy loads on the jack-up means used are simply avoided.

In a preferred embodiment, a method according to the invention is further characterized by the features of claim 11.

The displacement of the air from the storage tank has the advantage that during sinking, compression problems of the air are avoided, while, furthermore, the (slightly negative) buoyancy of the storage tank can be more easily adjusted and maintained.

In further elaboration, a method according to the invention is further characterized by the feature of claim 12.

By controlling the movements of the storage tank during lowering by means of the jack-up means, preferably those of the jack-up platform, the movements of the storage tank can be controlled even more properly.

In a method according to claim 13 the storage tank is placed first and the jack-up platform is positioned thereon later.

This enables drilling wells before the jack-up platform is finished.

The invention moreover relates to a method for displacing a jack-up platform according to the invention. According to the invention, such method is characterized by the features of claims 14 and/or 15.

This way, a method is provided for conveniently and efficiently displacing and positioning the platform.

In further elaboration, a method according to the invention is characterized by the features of claim 16. The advantage of this method is that the hardening means can be poured between the legs/feed-through pipe and the storage tank, thus creating a large contact area.

In still further elaboration, a method according to the invention is characterized by the features of claim 17.

This has the advantage that axial forces between the legs/feed through pipe and the storage tank are transmitted in an improved manner.

In yet further elaboration, a method according to the invention is characterized by the features of claim 18.

This way, positioning the legs relative to the storage tank can be carried out relatively easily, while maintaining separate mobility of the storage tank to the last moment.

The invention moreover relates to a storage tank for use with an assembly or method according to the invention.

Further advantageous embodiments of an installation or method according to the invention are further described in the subclaims and are specified in the description.

To explain the invention, exemplary embodiments of a jack-up platform and method will hereinafter be described, with reference to the accompanying drawings. In these drawings.

Figure 1:
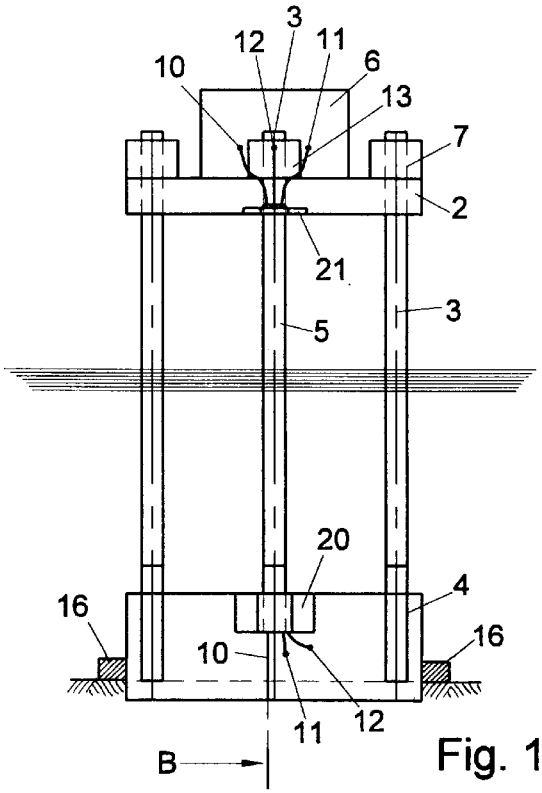
FIG. 1 is a front view of an assembly according to the invention, in operating position.
Figure 2:
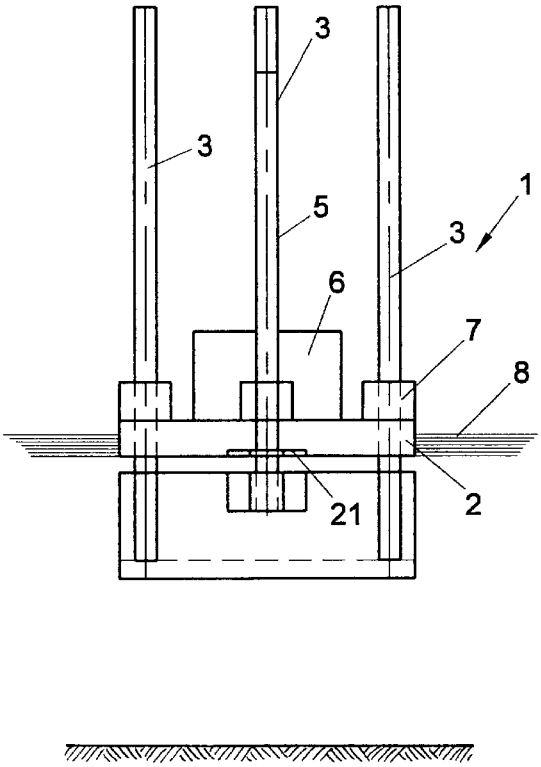
FIG. 2 is a front view of an assembly according to FIG. 1, in transport position.
Figure 3:
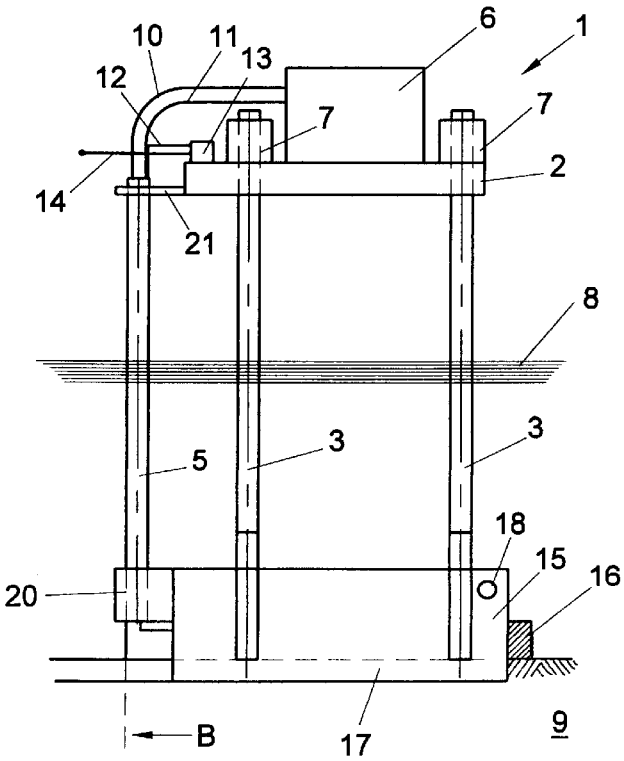
FIG. 3 is a side elevational view of an assembly according to FIGS. 1 and 2, in operating position.

An assembly 1 according to FIGS. 1–3 comprises a platform 1, three legs 3, a storage tank 4 and a feed-through pipe 5. The platform 2 comprises or has built thereon utility installations 6, such as a processing apparatus, accommodation spaces, different decks and like conventional installations.

Via jack-up means 7 connected to the platform 2, the platform 2 is connected to the legs 3 for movement in vertical direction. In the exemplary embodiment shown, the legs 3 extend through the storage tank 4 and are connected to the upper side as well as to the lower side of the storage tank 4. Hence, the storage tank 4 has a horizontal section which is larger than the surface area enclosed between the legs 3. During a vertical movement of the legs 3, the storage tank 4 moves along in vertical direction.

In the operating position shown in FIG. 1, the storage tank 4 has its lower side resting on a sea bedding. The legs 3 project from the water surface 8, with the platform 2 being supported by the legs 3 at a distance above the water surface 8. From the bored well B, a first pipe 10 extends through the feed-through pipe 5 to near the utility installations 6. Via the first line 10, a hydrocarbon such as oil is pumped from the bored well B to the utility installation and is treated therein, after which it is pumped through a second line 11 extending through the feed-through pipe 5 to the storage tank 4. In this manner, oil pumped from the bored well can be pumped to the storage tank 4 in processed or unprocessed condition. From the storage tank 4, a third line 12 extends through the feed-through pipe 5 to a coupling point 13. From the coupling point 13, a coupling line extends. To this coupling line 14, a discharge line can for instance be connected or an oil tanker or like discharge means.

The storage tank 4 comprises first ballast means 15 which provide a proper positioning of the storage tank on the bedding 9. Moreover, additional ballast means may possibly be supplied for, in the condition shown in FIG. 1, weighting the storage tank so as to obtain a further anchoring. Further, the storage tank 4 has its lower side provided with an apron 17 extending all around, which apron is pressed into the bedding 9 when the storage tank is loaded by the jack up platform and the ballast means 15, 16, as a result of which an anchoring against, in particular, lateral displacements is obtained. Moreover, this creates an enclosed space below the storage tank, which space will render an upward movement of the storage tank more difficult. The method of attaching the storage tank to the legs will be elucidated further on in this text.

Due to the relatively large surface of the storage tank 4, a good surface-pressure distribution over the bedding 9 is obtained, so that no further foundation mattresses or like foundations are necessary for a proper positioning of the jack-up platform 1 onto the bedding 9.

If the jack-up platform 1 is to be displaced, the relevant lines are removed from the bored well and the additional ballast means 16, if any, are detached from the storage tank 4 and the weight of the storage tank 4 is adjusted in such a manner that the weight thereof is approximately equal to that of the water displaced by the storage tank 4. To that end, water may be fed into the storage tank 4 via water-feed means 18 or, by contrast, removed therefrom. Via the jack-up means 7, the platform 2 is moved down to the water surface 8, so that the platform enters into a floating condition. Next, the legs 3 are moved upwards by the jack-up means 7, while taking along the storage tank 4. Owing to the properly adjusted weight of the storage tank 4, the downward force exerted on the platform 2 by the storage tank 4 is slight, the storage tank 4 practically floating in the water. Hence, a relatively slight buoyancy is sufficient for keeping the jack-up platform 1 afloat in the condition shown in FIG. 2, while the storage tank 4 provides an enhanced stability. In the condition shown in FIG. 2, the jack-up platform 1 can be towed to a new position, where the jack-up platform 1 can be brought back into the condition shown in FIG. 1. To that end, the storage tank 4 is controlled, by means of the jack-up means 7, in the direction of the seabed 9. As the weight of the storage tank 4 is slightly greater than the weight of the mass of water displaced thereby, the storage tank 4 will by itself lower relatively slowly in the direction of the seabed 9, if necessary braked or accelerated by means of the jack-up means 7. After the storage tank 4 has reached the seabed 9, the platform is moved upwards along the legs 3 by means of the jack-up means 7. This involves the storage tank 4 being pressed against the bedding 9 on account of the weight of the platform 2 with the utility structure 6 located thereon, with the apron 17 being pressed into the bedding. This creates a proper anchoring of the storage tank 4. Contiguously, the ballast means 16, if any, are connected to the storage tank 4, while moreover, by means of the water-feed means 18, the weight of the storage tank can be adjusted, if necessary. Contiguously, the first line 10 can be connected to the bored well, and the jack-up platform can be set in operation. Also, a feed-through line can be used to feed a drill through during drilling operations.

Figure 5:
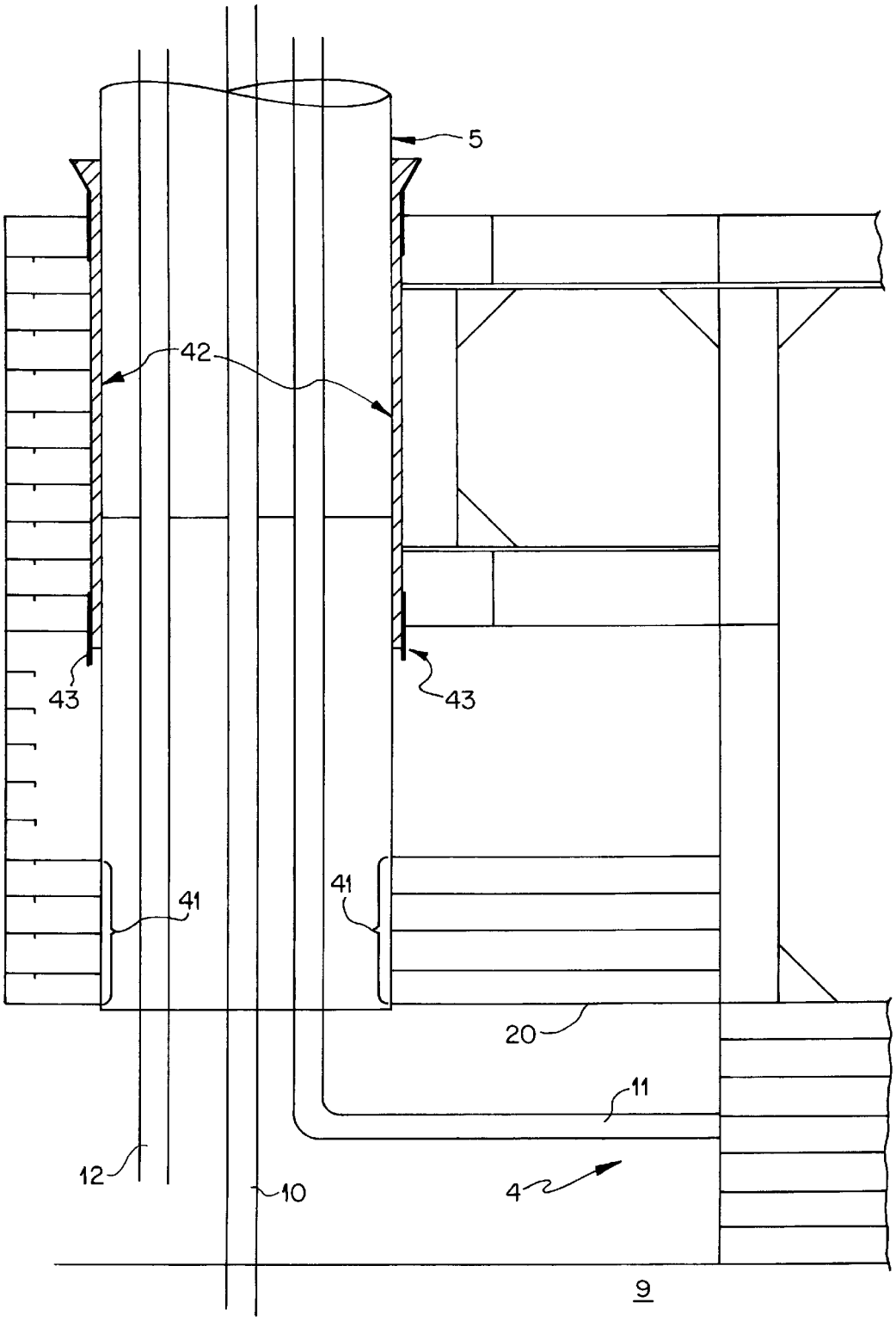
FIG. 5 shows a schematical cross sectional view of the connection of the feed-through pipe to the storage tank.

On one side of the storage tank 4, the feed-through pipe is fixedly connected thereto via a mounting block 20. Referring to FIG. 5, the feed-through pipe 5 is preferably connected to the guiding block 20 using both a welded connection 41 as well as a grout or concrete sleeve 42 as connection means. Preferably, the welded connection 41 is used to connect the end of the feed-through pipe 5 to the lower part of the mounting block 20 to absorb axial forces on the feed-through pipe 5. The grout sleeve 42 mainly absorbs the horizontal forces and the moments resulting from currents between the feed-through pipe 5 and the storage tank 4. After insertion of the feed through pipe 5 in the mounting block 20, the grout is poured between the feed-through pipe 5 and the mounting block 20, using seal 43 as a stopper until it hardens. Without being bound to any theory it is believed that using grout or concrete for the connection has the advantage that it leaves the surface of the feed-through pipe 5 smooth and thus wear-resistant. In addition, the connection can be put into place under water.

It should be noted that in FIG. 5 the mounting block 20 is positioned somewhat above the bedding 9 such that it can be placed over a well head. Of course it is also possible to position the mounting block 20 on the same level as the bedding 9, especially when forming the well after placing the storage tank. Further, in FIG. 5 can be seen how feed through lines 10, 11 and 12 are positioned and shielded within the feed-through pipe 5.

Referring to FIGS. 1, 3, attached to the jack-up platform 2 and straight above the mounting block 20 is a guide block 21, which guide block comprises guide means for the feed-through pipe 5. Hence, during a relative displacement of the platform 2 relative to the storage tank 4, the feed-through pipe 5 is guided in the guide block 21, so that the vertical position of the feed-through pipe 5 is maintained continuously. During use, the feed-through lines 10, 11 and 12 and any further lines, such as for instance control lines, are adequately protected by the feed-through pipe 5 against damage by, for instance, objects floating in or moving through the water, and against movements caused by currents in the water. Also during transport of the jack-up platform or the storage tank 5 as a separate unit, the lines extending through the feed-through pipe 5 are protected in a particularly simple and suitable manner. The connecting lines between the storage tank 4 and the utility structure 6 can continue to extend through the feed-through pipe 5 in any position. Hence, assembling operations are not necessary therefor, the lines merely need to be connected.

A jack-up platform 1 according to the invention is particularly simple in use, can be of a relatively light construction and has the major advantage over known jack up platforms of the subject type that storage means for the hydrocarbons extracted from the relevant bored well are fixedly connected to the jack-up platform and can be transported together therewith in a simple manner. Moreover, a jack up platform according to the invention can be placed and displaced in a particularly simple manner, in particular as placement of a separate foundation prior to the positioning of the jack-up platform can be omitted. In the transport position shown, a jack-up platform 1 according to the present invention is displaceable in a stable and simple manner.

Figure 4:
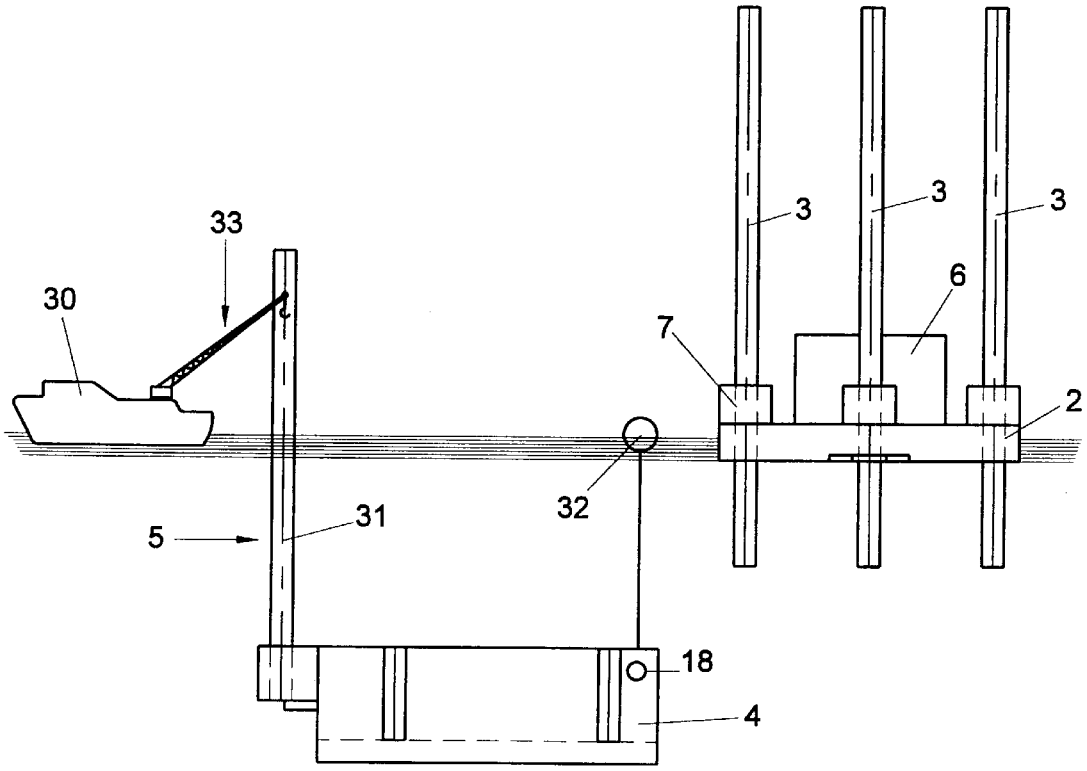
FIG. 4 shows an alternative embodiment of an assembly according to the invention.

FIG. 4 shows an alternative embodiment of an assembly according to the invention, comprising component parts identical to those in FIGS. 1–3. In this embodiment, however, the storage tank 4 has been moved to its place of destination separately from the platform 2 with the legs 3, by means of a tug 30 or the like. For that purpose, the storage tank comprises at least two floats. The first float is formed by the feed-through pipe 5 which is closed in such a manner that an air compartment 31 is formed therein. The second float 32 is connected to the storage tank 4 at the opposite side thereof and is for instance buoy-shaped.

At its place of destination, the storage tank 4 can be sunk by increasing the weight thereof, for instance through the in-feed of water and/or through reduction of the buoyancy of the floats 31 and/or lengthening the cable to 32. Preferably, the storage tank 4 is light-weight and thin walled and comprises a reinforced chamber capable of containing air under water. The buoyancy of the storage tank can be controlled by letting the water into the reinforced air chamber using remotely operated valves. If necessary, sinking of the storage tank 4 may involve using a floating jack-up apparatus 33 for specifically controlling the movements of the storage tank 4.

An advantage of using a light weight storage tank 4 is that it floats with relatively little air inside, carrying relatively much water as ballast. This way, the storage tank 4 has high floating stability. Preferably, the bottom of the storage tank is weighted, thus further enhancing floating stability.

After the storage tank 4 has thus been placed, the floats, at least the second float 32, are removed, while the feed-through pipe 5 is cleared. Next, the jack-up platform is towed or moved to a position above the storage tank and brought into an operating position in the usual manner, as shown in FIGS. 1 and 3, while the legs 3 are connected to the storage tank 4 to obtain a safe, stable construction. Upon filling the storage tank 4 with oil, the water is forced out from both the main tank and the air chamber. Preferably, the water is fed upwards to the platform 1 via feed-through line 11, such that it can be checked for any contamination (FIG. 5).

Figure 6:
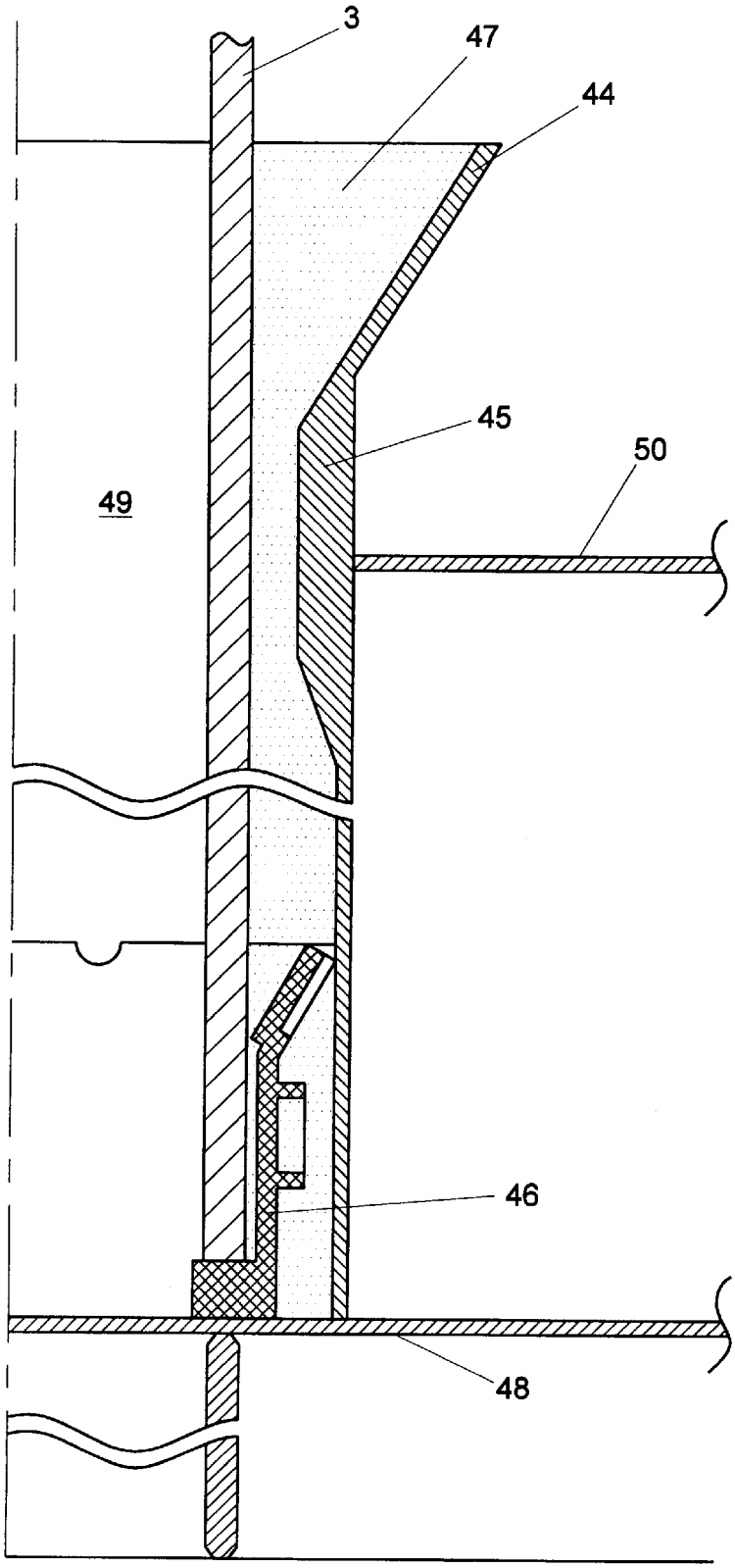
FIG. 6 shows a schematical cross sectional view of the connection of the legs to the storage tank.

Referring to FIG. 6, the storage tank 4 comprises blind holes 49 in each of which a leg 3 can be mounted, preferably while the storage tank 4 is located on the bedding 9. During connection, the platform 1 floats, while the legs 3 are lowered. To guide the legs 3 towards their corresponding holes 49, the top 50 of the storage tank 4 and the holes 49 are provided with funnel-like guiding means 44. These guiding means can also include rails or bars attached to the top 50 of the storage tank 4 (not shown). To protect the bottom 48 of the storage tank 4 from being punched through by the legs 3, the hole 49 is provided with resilient rubber pads 46 or the like to absorb the energy of a leg approaching the bottom 48 too fast. Also, these pads 46 can be used to hold the leg 3 temporarily in place while it is further connected to the storage tank 4. Further attachment is carried out by pouring grout, concrete or similar hardening means into the remaining area of the holes 49, thus creating a sleeve 47. This sleeve 47 transmits, after it has hardened, horizontal forces and moments between the storage tank 4 and the legs 3. The hole 49 can be provided with a ridge 45 to prevent the legs 3 with their sleeves 45 from being pulled out of their holes 49, e.g. while lifting the storage tank 4. If necessary, a welded connection between the leg 3 and the storage tank 4 can be used to further enhance axial strength of their connection.

The invention is by no means limited to the embodiments described and shown in the description and the drawings. Many variations thereto are possible. For instance, a different number of legs may be provided, for instance 4 or 5 instead of 3, while the feed-through pipe 5 may extend in a different position, for instance centrally between the legs 3, and the first feed-through line 10 may extend through the storage tank 4 into the bored well B. The storage tank 4 may be constructed in one piece, but may also comprise different storage spaces and different storage tanks, while, moreover, a number of water tanks may be provided, suitable as ballast tanks. The feed-through pipe 5 may be accommodated in, or at least integrated into one of the legs 3. The anchoring means may be designed as pins, aprons which may or may not be continuous and which extend in one or more directions below the storage tank 4, or like anchoring means. The legs 3 may be mounted on the outside of the storage tank 4 or fixed to the upper side of the storage tank 4. The relatively great height of the storage tank 4 offers the advantage that the legs 3 may be of a relatively short design, as a result of which the stability of the jack-up platform is increased, in particular in the operating position. A jack-up platform 1 according to the invention may comprise drive means of its own.

These and many other variations are understood to fall within the framework of the invention.

We claim:

1. An assembly of a jack-up platform and at least one storage tank, wherein the jack-up platform is floatingly displaceable and can be set up by means of legs, in such a manner that the jack-up platform is located at a distance above the water surface, wherein the storage tank is adapted to be placed on a water bedding and comprises means for attaching the legs, in such a manner that the jack-up platform is supported by the storage tank, wherein the storage tank is adapted to receive at least a hydrocarbon compound, wherein means are provided for leading the hydrocarbon compound into and out of the storage tank, wherein during the support of the jack-up platform the storage tank extends at least partially below the jack-up platform.

2. An assembly according to claim 1, comprising a platform and at least three legs, wherein the platform is connected to the legs by means of guide means and is movable along said legs by means of jack-up means, wherein tank-shaped ballast means are provided which are arranged adjacent the lower ends of the legs and adapted to receive a fluid whose specific mass is at the most equal to the specific mass of the water surrounding the ballast means during use, said ballast means being movable between at least a transport position and a support position, characterized in that the ballast means comprise the storage tank, the storage tank being movable by means of the jack-up means.

3. An assembly according to claim 1, characterized in that the means for leading the fluid, the hydrocarbon compound, or both into and out of the storage tank are adapted so that the storage tank in the transport position substantially floats in the surrounding water.

4. An assembly according to claim 1, characterized in that one storage tank is provided, connected to all legs, adjacent the free ends thereof, wherein, in top plan view, the legs preferably extend within the contours of the storage tank.

5. An assembly according to claim 4, characterized in that the legs are fixedly connected to the storage tank.

6. An assembly according to any one of the preceding claims, characterized in that the storage tank comprises, on the side facing the bedding, anchoring means for cooperation with the bedding, said anchoring means comprising at least one downwardly extending wall part.

7. An assembly according to claim 1, characterized in that at least one feed-through pipe is provided, attached on the storage tank side to the storage tank and extending in approximately vertical direction from a side of the storage tank, wherein the platform comprises guide means for the feed-through pipe, the arrangement being such that when the storage tank and the platform move relative to each other, the feed-through pipe is substantially stationary relative to the storage tank and is guided by the guide means, wherein during use, feed-through lines extend through the feed-through pipe from the upper side of the platform at least to near the first end thereof.

8. An assembly according to claim 1, characterized in that the storage tank is displaceable separately from the jack-up platform to a set-up position and comprises means for coupling the jack-up platform to the storage tank.

9. An assembly according to claim 1, wherein at least one of the legs or the feed-through pipe are at least partially attached to said storage tank by means of hardened hardening means in between at least one of said legs or said through feed pipe and said storage tank, for during use transmitting horizontal forces and moments between said platform and said storage tank.

10. A method for placing an assembly of the type described in claim 1, comprising bringing the storage tank into the transport position and filling the storage tank at least partially, so that the weight of the filled storage tank is approximately equal to the weight of the water displaced thereby, floatingly moving the jack-up platform to a place of destination, lowering the storage tank onto the bedding, and subsequently jacking-up the platform upwards along the legs to a position above the water surface, while pressing the storage tank against the bedding.

11. A method according to claim 10, wherein in or at least before reaching the transport position, the storage tank is filled substantially completely, in such a manner that the air in the storage tank is pressed away and replaced by fluids.

12. A method according to claim 10 or 11, wherein the assembly has jack-up means and the storage tank during lowering is moved in a controlled manner by the jack-up means from the transport position into the support position.

13. A method according to any one of claims 10 or 11, wherein the storage tank is moved separately from the jack-up platform to a place of destination and sunk, after which the jack-up platform is set up on the storage tank by means of the legs.

14. A method for displacing an assembly of a jack-up platform according to claim 1 wherein said assembly includes jack-up means, and said method comprises moving in jack-up platform from an operating position down along the legs by means of the jack-up means, approximately into a floating position, adjusting the filling of the storage tank so that the weight of the storage tank together with the filling becomes at least approximately equal to the weight of the water displaced thereby, wherein by means of the jack-up apparatus, the legs are moved upwards relative to the platform while carrying along the storage tank, until the storage tank has been brought into the transport position.

15. A method for displacing an assembly of a jack-up platform according to claim 1 wherein said assembly includes jack-up means, and said method comprises moving in jack-up platform from an operating position down along the legs by means of the jack-up means, approximately into a floating position, adjusting the filling of the storage tank so that the weight of the storage tank together with the filling becomes equal to or slightly less than the weight of the water displaced thereby, so that transport can take place with a raised freeboard wherein by means of the jack-up apparatus, the legs are moved upwards relative to the platform while carrying along the storage tank, until the storage tank has been brought into the transport position.

16. Method according to claim 10, wherein said assembly comprises at least one feed-through pipe, wherein the platform comprises guide means for the feed-through pipe, the arrangement being such that when the storage tank and the platform move relative to each other, the feed-through pipe is substantially stationary relative to the storage tank and is guided by the guide means, wherein during use, feed-through lines extend through the feed-through pipe from the upper side of the platform at least to near the first end thereof, and at least one of said legs or feed through pipe are at least partially attached to said storage tank.

17. Method according to claim 16 wherein at least one of the legs or the feed through pipe are at least partially attached to said storage tank by welding or similar attachment methods.

18. Method according to any one of the claims 14–17 wherein, after reaching said destination, said legs are attached to said storage tank.

19. Method according to claim 16, wherein at least one of said legs or feed though pipe are at least partially attached to said storage tank using concrete or grout.

20. An assembly according to claim 1, wherein said storage tank comprises, on the side facing the bedding, anchoring means for cooperation with the bedding, said anchoring means comprising at least one downwardly extending an apron shaped edge which extends at least partially all sides.

21. A method for assembling a jack-up platform according to claim 1, comprising bringing the storage tank into the transport position and filling it at least partially, whereby the weight of the filled storage tank is approximately equal to the weight of the water displaced thereby, floatingly moving the jack-up platform to a place of destination, lowering the storage tank onto the bedding, and subsequently jacking-up the platform upwards along the legs to a position above the water surface, while pressing the storage tank against the bedding.

22. A method according to claim 21, wherein the storage tank is filled substantially completely whereby the air in the storage tank is pressed away and replaced by fluids (a) when the storage tank has been brought to the transport location or (b) before the storage tank has been brought to the transport location.

* * * * *